US005720416A

United States Patent [19]

Izoe

[11] Patent Number: 5,720,416

[45] Date of Patent: Feb. 24, 1998

[54] DISPENSER FOR VISCOUS LIQUIDS

[76] Inventor: Jolly Fields Izoe, 2409 E. 49th St. North, Tulsa, Okla. 74130

[21] Appl. No.: 702,387

[22] Filed: Aug. 14, 1996

[51] Int. Cl.[6] ..... B67D 5/52; B67D 5/42

[52] U.S. Cl. ..... 222/138; 222/386

[58] Field of Search ..... 222/135–138, 222/251, 252, 319, 330, 386

[56] References Cited

U.S. PATENT DOCUMENTS

| | | | |
|---|---|---|---|
| 1,455,333 | 5/1923 | Greaves . | |
| 2,205,836 | 6/1940 | Parets . | |
| 2,500,687 | 3/1950 | Kamp et al. . | |
| 3,220,615 | 11/1965 | Spatz . | |
| 3,563,414 | 2/1971 | Coulombe et al. | 222/386 X |
| 3,760,985 | 9/1973 | Bryan | 222/386 X |
| 4,509,641 | 4/1985 | Scieri et al. . | |
| 4,972,969 | 11/1990 | Randklev . | |
| 4,981,241 | 1/1991 | Keller | 222/137 |
| 4,989,758 | 2/1991 | Keller . | |
| 5,038,963 | 8/1991 | Pettengill et al. | 222/137 X |
| 5,114,004 | 5/1992 | Isono et al. . | |
| 5,238,151 | 8/1993 | Weinstein . | |
| 5,269,441 | 12/1993 | O'Meara . | |
| 5,301,842 | 4/1994 | Ritter . | |
| 5,310,091 | 5/1994 | Dunning et al. . | |
| 5,387,034 | 2/1995 | Bauer et al. . | |

FOREIGN PATENT DOCUMENTS

| | | | |
|---|---|---|---|
| 353481 | 10/1937 | Italy | 222/386 |
| 232466 | 9/1944 | Switzerland | 222/386 |
| 399233 | 10/1933 | United Kingdom | 222/386 |
| 511748 | 8/1939 | United Kingdom | 222/386 |

*Primary Examiner*—Kevin P. Shaver
*Attorney, Agent, or Firm*—Leonard Belkin

[57] ABSTRACT

A dispenser for viscous liquids in which a hollow cylindrical body is provided with stationary walls. A rotatable member with vanes is situated within the body so that rotation of the vanes will cause the liquids contained within the body to be squeezed out through a nozzle in one end of the main body. The other end of the main body is provided with a rotatable cap to turn the vanes within the body.

15 Claims, 4 Drawing Sheets

DISPENSER FOR VISCOUS LIQUIDS

BACKGROUND OF THE INVENTION

The present invention relates to a dispenser for viscous liquids and more particularly to a dispenser with improved capability to preserve and dispense viscous liquids within.

There are a large number of dispensers available which are useful to dispense such food products as mayonnaise, catsup, mustard, and the like, as well as toothpaste and other products. In conventional containers for dispensing these viscous liquids, the product within the dispenser becomes exposed to air once the seal is broken and some of the contents are dispensed. Moisture in the air above the product condenses when the dispenser is placed in the refrigerator for storage between uses thereby depositing water on the product. Dispensers placed on counters in fast food and other restaurants represent an unsanitary condition due to ambient air coming into contact with the liquid within the dispenser.

A number of patents have been issued which disclose dispensers of viscous liquids.

U.S. Pat. No. 1,455,333 discloses a receptacle for mustard which incorporates a mixing chamber divided into two compartments with the contents from one compartment being returned to the body of the receptacle. There is no provision for isolating the contents from contact with air.

U.S. Pat. No. 2,205,836 shows a dispensing container for paste, grease, etc. with no structure designed to seal the contents.

U.S. Pat. No. 2,500,687 has a cosmetic dispenser in which a vane is rotated to push the contents out of a dispensing hole or opening into an open well located at the top of the container. The contents are expelled directly from the chamber through the dispensing hole.

U.S. Pat. No. 3,220,615 discloses dispensers for fluent masses in which a vane is rotated to force the contents out through a discharge orifice located on the side of the container or, in another embodiment, out through a discharge tube located in the container and extending up the side of an outer wall. The apparatus is complicated in construction.

U.S. Pat. No. 4,509,641 shows a mixing and dispensing container which utilizes a collapsible bag located within a pressurized vessel. Pressurization causes the mixing and discharge of the components.

U.S. Pat. No. 4,972,969 describes an assembly for storing mixing and dispensing preparations utilizing an ampule containing a single, pre-dosed reactive ingredient to be mixed with other ingredients at the time of use. A plunger is employed to collapse the ampule and produce the mixing.

U.S. Pat. No. 4,989,758 discloses a double delivery cartridge for two masses in which two reservoir cylinders are arranged with parallel axes side by side with a common orifice for both cylinders.

U.S. Pat. No. 5,238,151 describes a container for dispensing two or more semi-solid products operable by outside manual motion. The device employs multiple fins which move in unison to discharge the products. Discharge takes place through the side wall of the container.

U.S. Pat. No. 5,114,004 discloses a filled and sealed, self-contained mixing container which includes separate compartments in communication with each other so that the individual contents can be mixed within the container.

U.S. Pat. No. 5,269,441 has a dual compartment container assembly with two adjacent compartments separated by a common wall segment. Discharge takes place through separate discharge ports mounted on one end of the compartments. The compartments are squeezed to provide for the discharge.

U.S. Pat. No. 5,301,842 discloses a multicomponent cartridge for plastic materials for proportioning and discharging the materials. The invention employs a multichamber cartridge and pistons to force out the materials.

U.S. Pat. No. 5,310,091 describes a dual product dispenser in which the products are dispensed simultaneously and mixed from front and rear chambers and a piston mounted within each of the chambers. Telescoping movement of the rear chamber within the front chamber forces the products out.

U.S. Pat. No. 5,387,034 discloses a mixing device for two products comprising two separate containers with controlled communication between them and a push button discharge nozzle at the end of one of the containers.

None of the above patents teaches the present invention.

SUMMARY OF THE INVENTION

This invention provides a unique throw-away dispenser for viscous liquids in which air is kept away from the product within the dispenser and is easy and inexpensive to manufacture.

In a preferred embodiment of the invention there is provided a cylindrical main body closed off at its upper end with a stationary seal cap and at the lower end a mixing chamber and a nozzle. A rotatable knob closes the top of the main body.

The interior of the main body has mounted therein a pair of stationary, radially inwardly extending flat walls leaving a space along the central axis for a rotatable center rod. A pair of vanes are mounted on the center rod to correspond with the flat walls. In the initial position of the center rod each vane is situated so as to lie adjacent or near a corresponding flat wall, forming a pair of compartments within the main body. Thus, two different viscous liquids may be contained within the main body.

The bottom of the center rod is hollow forming a cavity and extends beyond the vanes into a hollow hub cap containing the nozzle. The wall of the center rod has openings or slots to provide communication between the compartments and the hollow portion of the rod. A divider may be employed to form two pockets to provide a separate pocket for each compartment so that the liquids exit through the nozzle unmixed, or the divider may be omitted to permit mixing of the two liquids within the hollow portion of the center rod.

The knob engages the center rod so that as the upper cap is manually turned, the rotation of the vanes forces the viscous liquids into the cavity of the center tube and out of the nozzle. Vents are provided for the widening empty space between each vane and flat plate to prevent any back leakage.

One of the features of this invention is that when a period of dispensing is completed, the liquids within the dispenser remain free of any contact with air thus increasing the shelf life of the partially used dispenser.

Another feature is that the nozzle can be cleared by reversing the movement of the center rod briefly, causing the mixture in the nozzle to be drawn back out of the nozzle, providing for a neater appearance.

Still another feature of this invention is the ability to dispense virtually all of the product within the dispenser. In many dispensers now available, there is always a significant amount of product left to be discarded with the apparatus.

It is thus a principal object of this invention to provide an efficient and effective apparatus for the dispensing of viscous liquids.

Another object of the invention is to provide a dispenser which prevents air from contacting the undischarged liquid thereby extending the preservation period for the contents of the apparatus.

Still another object is to be able to mix and dispense two different viscous liquids over a period of time without the need for a nozzle cap to prevent leakage.

Other objects and advantages of this invention will hereinafter become obvious from the following detailed description of preferred embodiments of this invention.

BRIEF DESCRIPTION OF THE DRAWINGS

The following figures, partially schematic, illustrate preferred embodiments of this invention.

DESCRIPTION OF THE PREFERRED EMBODIMENTS

Figure 1:
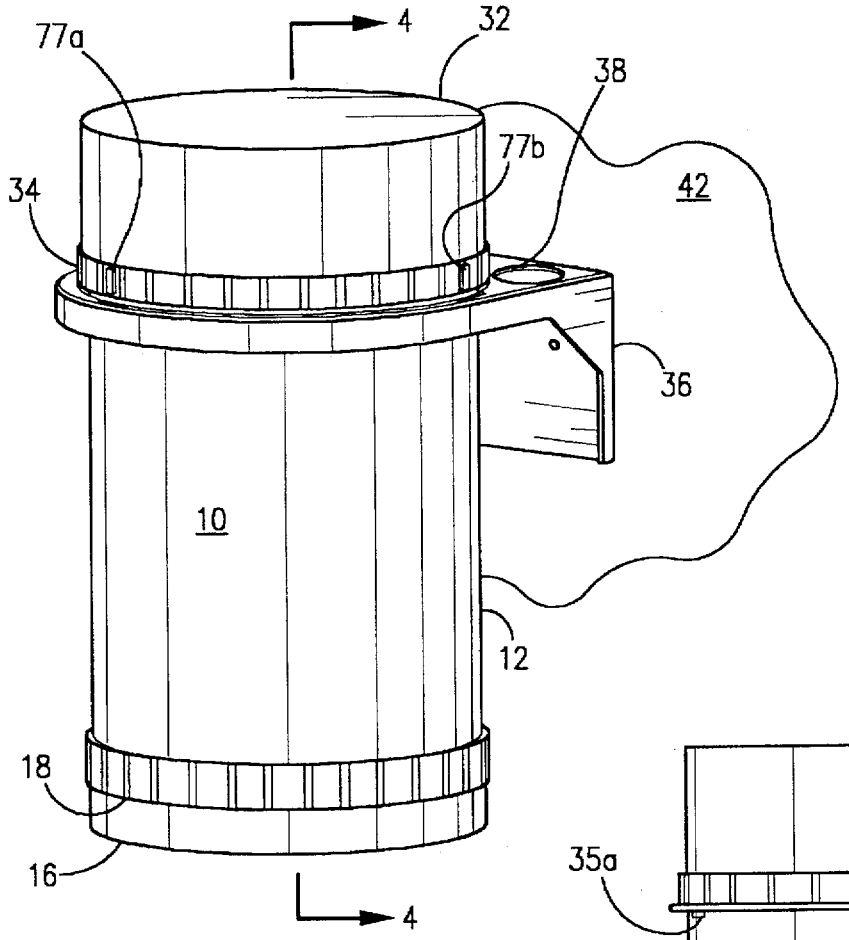
FIG. 1 is a perspective view of the preferred embodiment of this invention appropriate for dispensing a viscous liquid such as tooth paste.

Referring to FIGS. 1–6, dispenser 10 comprises a cylindrical main body 12 having a top edge 12*a* and a dispensing nozzle 14 extending from a cylindrical hub 15 surrounded by a bottom wall 15*a*. A nozzle cap 16 with knurling 18 covers nozzle 14 when dispenser 10 is not in use. A center rod 22 with a pair of vanes 24 and 26 is located within main body 12. A seal cap 28 is fitted onto the top opening of main body 12 and a knob 32 with knurling 34 fits over said seal cap 28. Knob 32 is large enough in diameter to act as a sleeve going down to main body 12 as illustrated.

Main body 12 has a flange 35 with projections 35*a* at 90 degrees, apart to be engaged by a bracket 36 with openings 38 for tooth brushes mounted on a wall 42 to support dispenser 10 and permit its convenient use. Slots 36*a* engage projections 35*a*. The bottom of center rod 22 rests in hub 15 as will be described further below.

Figure 6:
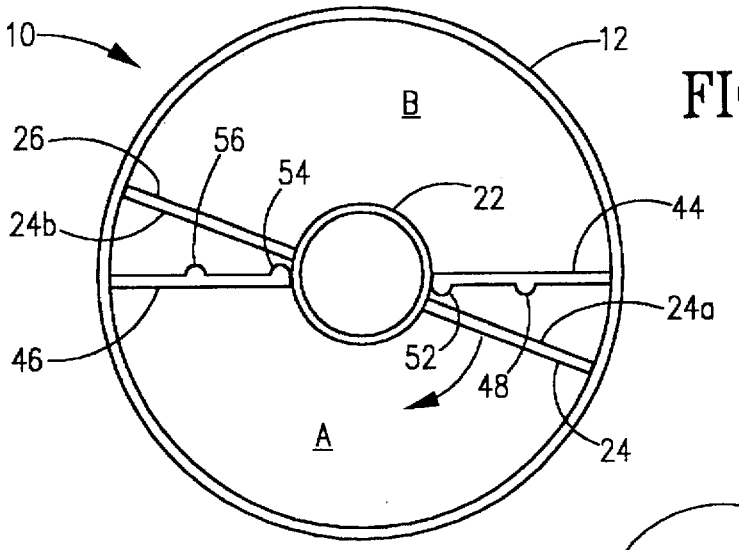
FIG. 6 is an illustration looking down into the main body of the embodiment shown in FIGS. 1–5.
Figure 5:
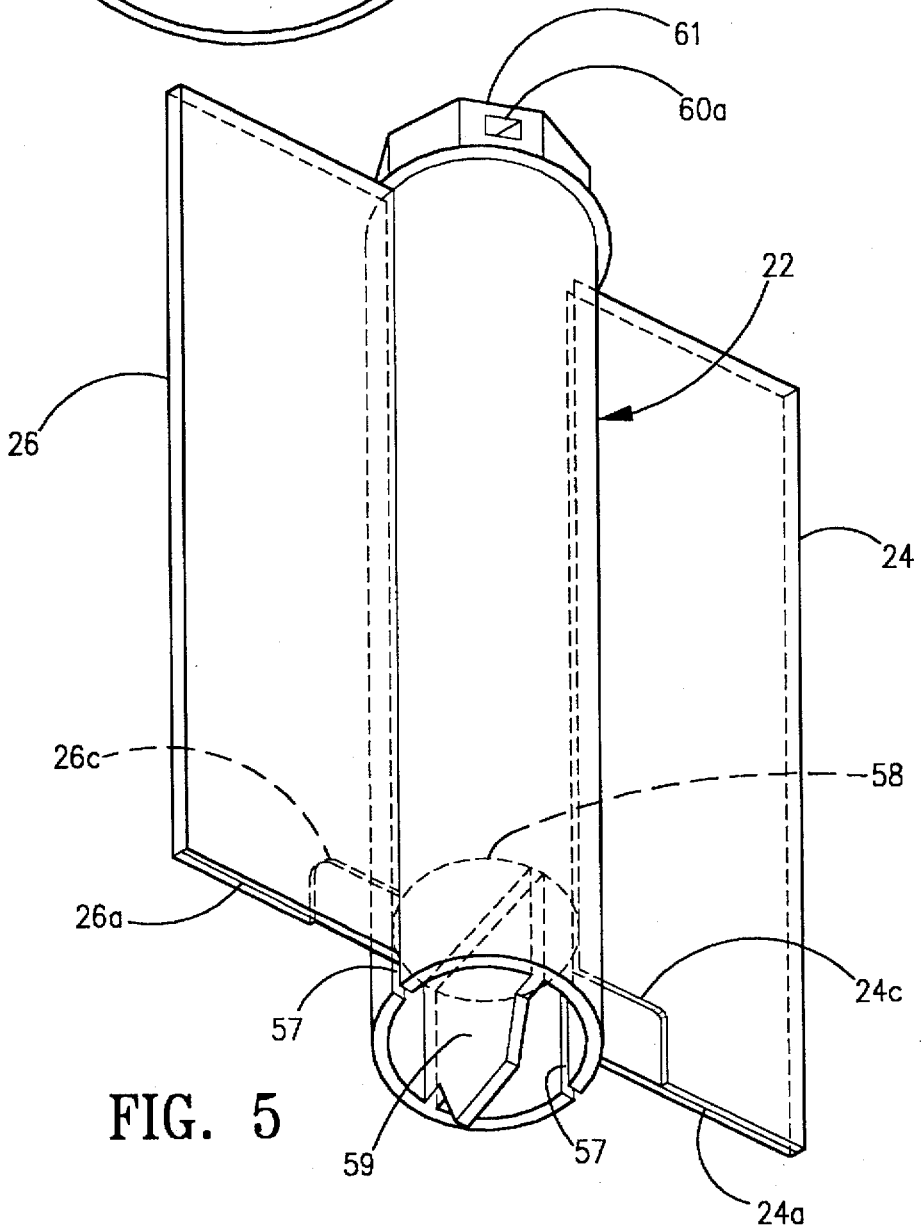
FIG. 5 is a perspective view of the center rod with vanes.

Within cylindrical main body 12 are mounted a pair of stationary flat walls 44 and 46 which are rectangular in configuration and are provided with reinforcement ribs 48, 52, 54, and 56, as best seen in FIG. 6. Where reinforcement ribs 52 and 54 contact center rod 22, these ribs are curved to match the curvature of the outer surface of rod 22 to provide a wiping action. The outer edges of vanes 24 and 26 are also curved to provide a wiping action.

Center rod 22 is inserted into main body 12 in its most counter clockwise position. In its initial position, there is 19 degrees dead air space between vanes 24 and 26, and flat walls 44 and 46, respectively. Thus, vanes 24 and 26 can be rotated through 161 degrees in a clockwise direction, as shown by the arrow in FIG. 6. The compartments between vane 24 and wall 46, and between vane 26 and wall 44, A and B, respectively, are filled initially with the same or different products, as desired or required.

Figure 7:
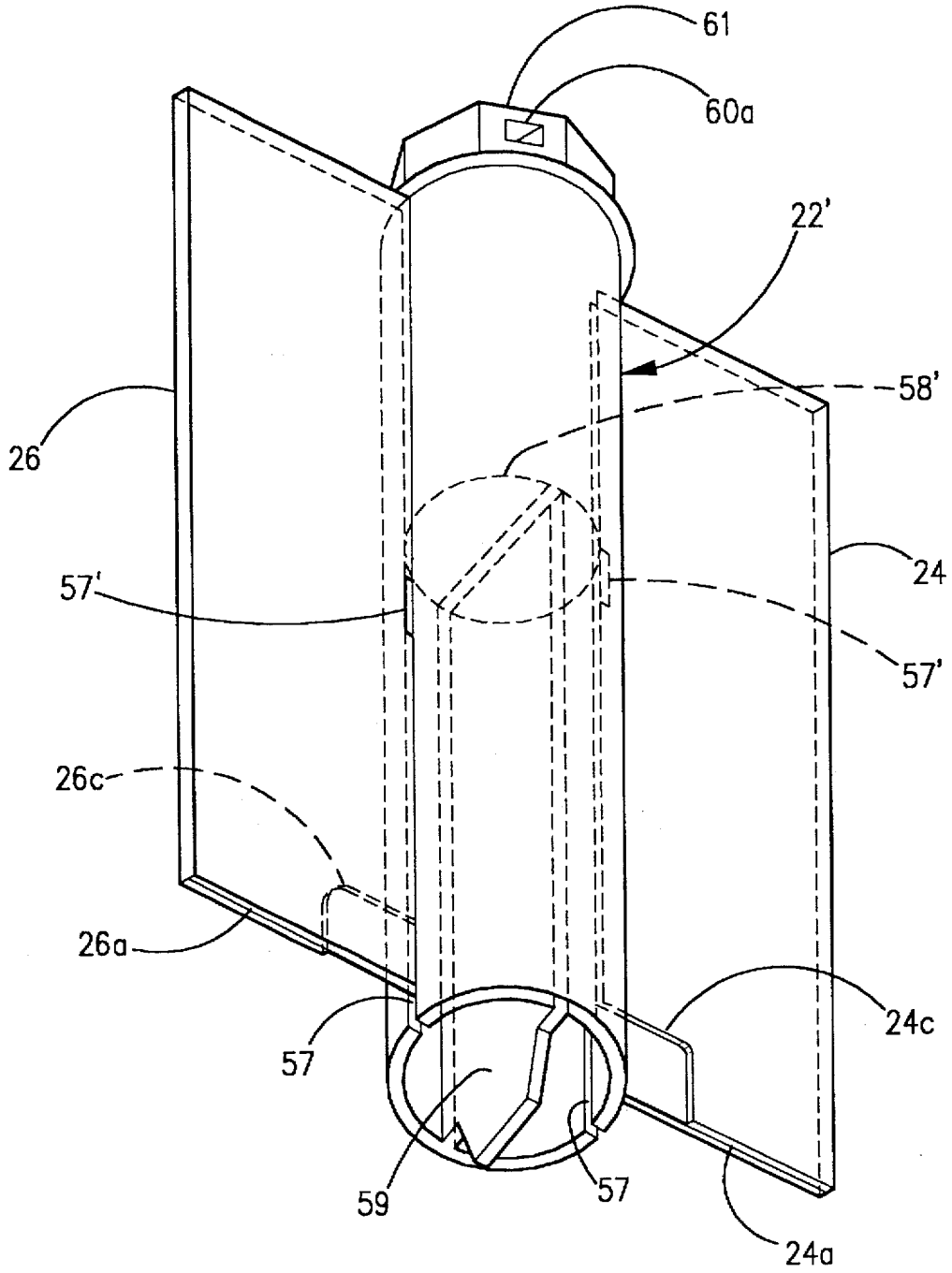
FIG. 7 is a figure similar to that of FIG. 5 showing an alternative embodiment.

The lower end of center rod 22 extends below the bottom edges of vanes 24 and 26 into hub 15. Feeding slots 57 are formed through the wall of center rod 22 and below vanes 24 and 26 to permit the liquids to pass from the compartments within main body 12 into a cavity formed within center rod 22. A rod wall 58 closes off the interior of center rod 22 to prevent flow of liquid up rod 22 which is solid above wall 58. The position of rod wall 58 along rod 22 may be located for the particular liquid or liquids to be dispensed. For example, if the liquid tends to have oil or water separate out, wall 58 may be higher along rod 22 to capture the liquid separating out. Feed slots 57 can be placed at any height on either side of rod 22. This alternative arrangement is shown in FIG. 7 with wall 58' located at a higher point along rod 22' and feed slots 57' located adjacent wall 58'.

Returning to FIGS. 1–6, vanes 24 and 26 are provided with grooves 24*c* and 26*c* to facilitate feeding of the liquids through slots 57 and to help insure that all of the liquids contained are dispensed. Vanes 24 and 26 are oversized and thinned out toward the outer edges to provide better wiping effect against the cylinder wall. The vertical height of these vanes are also oversized. Center grooves 24*a* and 26*a* in top and bottom of the vanes allow two thin walls instead of one thick wall for greater flexibility and better wiping effect against wall 15*a* at bottom and seal cap wall 62 at the top.

Figure 4:
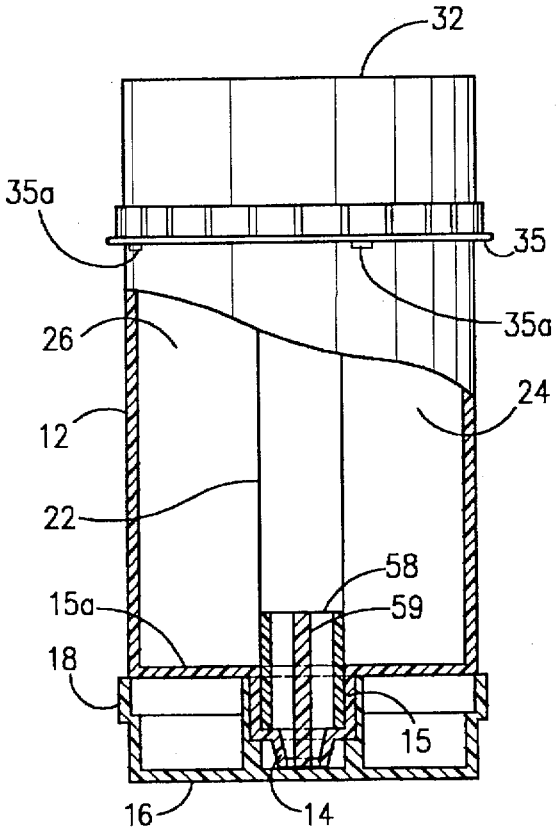
FIG. 4 is a partially cut away section along 4—4 of FIG. 1.
Figure 2:
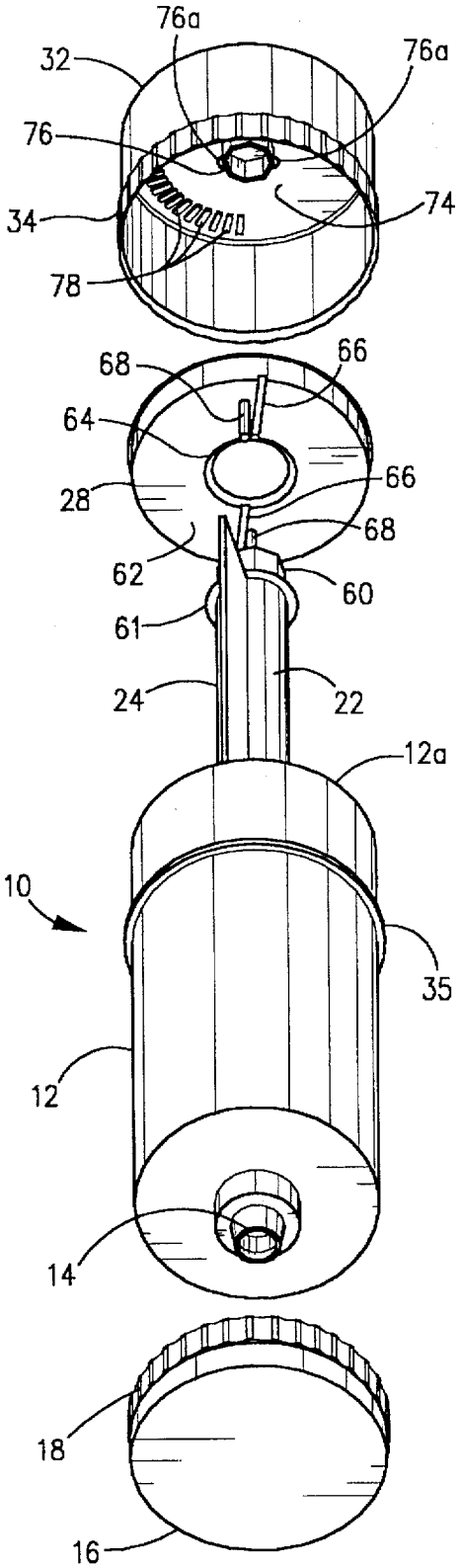
FIG. 2 is an exploded view from the bottom end of the embodiment shown in FIG. 1.
Figure 3:
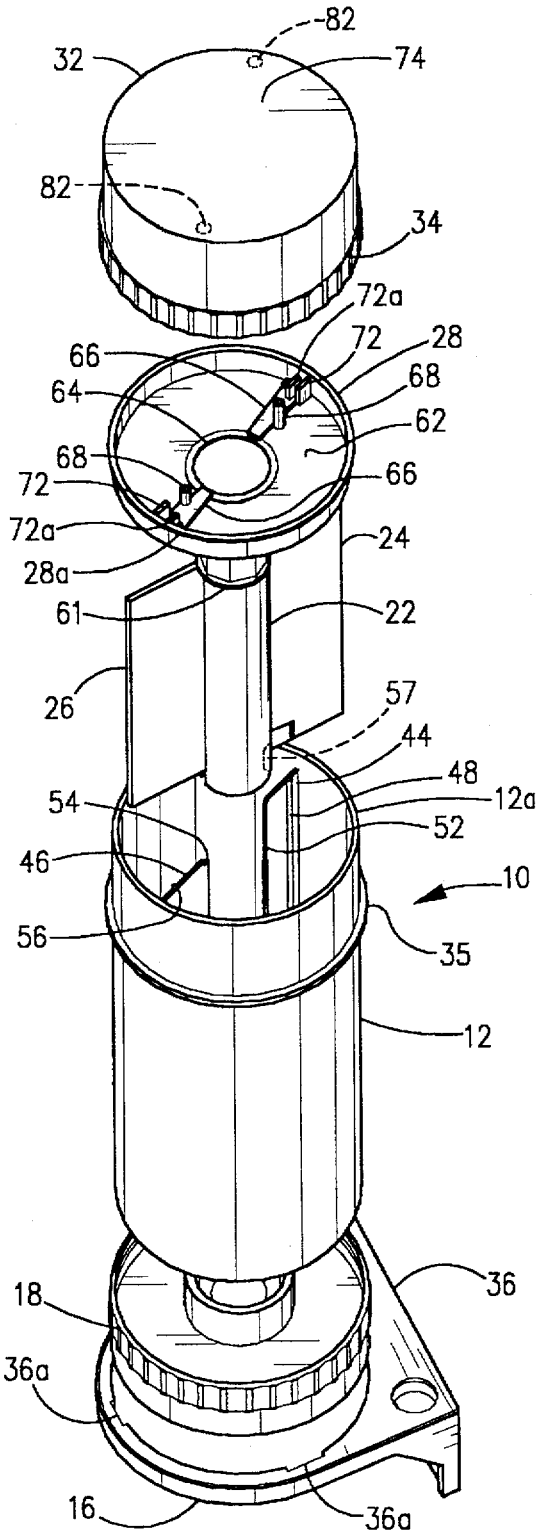
FIG. 3 is an exploded view from the top end of the embodiment shown in FIG. 1.

A center or divider wall 59 extending down from rod wall 58 separates the space within rod 22 below wall 58 into two separate pockets communicating with the two compartments, A and B, respectively, within main body 12. Wall 59 extends beyond the bottom of center rod 22 terminating at the exit opening in nozzle 14 as illustrated in FIG. 4. With center wall 59 in place, as illustrated, the two fluids come out of nozzle 14 in separate streams. If center wall 59 is not present, that is, center rod 22 is made without center wall 59, the two fluids will mix in the cavity below rod wall 58 before exiting nozzle 14.

The top of center rod 22 is provided with an octagon shaped female member 60 for a purpose to be described below and a vane seal disc 61.

Stationary seal cap 28 is cylindrical with a bottom wall 62 with a circular opening 64 large enough to permit octagon shaped member 60 to extend through when seal cap 28 is inserted into the top opening of main body 12. Circular opening 64 is sealed by vane seal disc 61 which rotates with center rod 22. Cap 28 is provided on the underside of lower wall 62 with a pair of grooves 66 which are press fit on the tops of stationary flat walls 44 and 46, and a pair of vent tubes 68 which extend through wall 62 down a short distance into the dead air space between vane 24 and wall 44, and vane 26 and wall 46, respectively, mentioned above. Vent tubes 68 by being extended also prevent any overflow, in the event of over filling, to pass into the dead air space, instead of going into vent tubes 68. When in place, seal cap 28 seals off the upper end of main body 12. The upper edge 28*a* of seal cap 28 may be sonic welded around and to the upper edge 12*a* of main body 12 when assembled.

The top surface of lower wall 62 is provided with rectangular blades 72 and shorter rectangular posts 72*a* for a purpose to be described below.

Knob 32 is cylindrical in shape with an upper wall 74 in which is mounted an octagon shaped male member 76 which engages female octagon member 60 mounted on center rod 22. Thus, rotation of knob 32 will turn rod 22 and vanes 24 and 26. Two prongs 76*a* at 180 degrees apart on the outside of male member 76 pop into slots 60*a* in female member 60 when they are assembled thereby preventing the consumer from removing the knob. Knob 32 may be provided with raised members 77*a* and 77*b* corresponding with appropriate markings on main body 12 or bracket 36 to indicate full and empty positions.

On the underside of upper wall 74 are non-reversible protruding teeth 78 to engage the top edges of rectangular blades 72 to prevent the accidental counter clockwise rotation of knob 32 and rod 22. Blades 72 bend away from posts 72*a* when contacted by teeth 78 in the direction away from posts 72*a*. When knob 32 is reversed, after each dispensing and when all of the liquid is dispensed (vanes 24 and 26 are turned to their fully clockwise position), in order to clean the nozzle tip, some reverse movement is permitted, until blades 72 are blocked from bending by posts 72*a*. This arrangement permits a small reversal of about 3.5 degrees.

Rotating knob 32 back and forth over this range permits air to enter the compartments of main body 12 which had contained the liquid which was dispensed, and to move the air forward through nozzle 14 effectively cleaning the latter by expelling any remaining liquid.

In addition, this arrangement compensates for shrinkage when the device is filled with a hot liquid which shrinks as it cools. The design is such that rod and vane assembly will move by force of vacuum to automatically compensate for the shrinkage so that the cylinder or no other part of the dispenser is distorted (ie, as the pull-in on a jelly jar lid). It is not contemplated that movement will be excessive. A small movement would not cause a vacuum lock behind the dual vanes, even if vent tubes 68 were not yet open, as is described below.

The underside of upper wall 74 of knob 32 is also provided with a pair of thin pads 82 which are positioned under tension to seal off vent tubes 68 until the consumer dispenses the first portion of the liquid within dispenser 10. As vent tubes 68 move away from pads 82, the pressure is released so vent tubes 68 do not drag knob 32. Pads 82 would be engineered with enough diameter so that vent tubes 68 will not open until first usage by the consumer.

In the operation of dispenser 10 described above, with center tube 22 inserted into main body 12 and vanes 24 and 26 in their most counter clockwise position, and with vanes 24 and 26 near or adjacent stationary walls 44 and 46 and the initial separation as described above, the liquids are poured into the two separate compartments.

Seal cap 28 and knob 32 are then put into place as previously described. With bottom cap 16 removed, clockwise rotation of knob 32 will force the liquids through slots 57 into pockets formed by divider wall 59 below wall 58 (or the cavity below wall 58 if divider wall 59 is not present) in center rod 22. From the pockets, the liquids will pass into nozzle 14. With divider wall 59 not present, the liquids will be swirled or mixed together before entering nozzle 14.

It is thus seen there has been provided a dispenser for viscous liquids which is highly effective in keeping the liquids out of contact with air for a longer shelf life when in use and is economical to manufacture, assemble and fill.

The apparatus of this invention can dispense two products simultaneously, keeping them separate until just before or at the nozzle, at the option of the manufacturer.

While only preferred embodiments of this invention have been described, it is understood that many variations are possible without departing from the principles of this invention as defined in the claims which follow.

What is claimed is:

1. A dispenser for viscous liquids comprising:

(a) a cylindrical main body for containing said viscous liquids open at the upper end and having nozzle means closing the lower end of said main body for dispensing said liquids;

(b) stationary seal cap means fitted into the top opening of and for sealing the upper end of said main body;

(c) rotatable knob means for covering the upper end of said main body and said seal cap means;

(d) means for dividing the interior of said main body into two axial extending separate compartments including a rotatable center rod extending through and along the central axis of said main body including a cavity formed within said center rod adjacent the lower end of said center rod in communication with said compartments;

(e) said nozzle means comprising a hub to receive the bottom end of said center rod and a nozzle communicating with the interior of said hub and cavity to discharge the viscous liquid within said main body;

(f) means in response to rotation of said knob means to engage and rotate said hollow center rod and force said viscous liquids from said compartments into said cavity of said center rod and through said nozzle means for discharge; and (g) means to vent the spaces vacated by discharging viscous liquid while preventing contact between incoming venting air and viscous liquid within said main body.

2. The dispenser of claim 1 having means within said cavity of said center rod for dividing said cavity into two separate pockets and for providing communication between each of said pockets and one of said compartments in said main body so that the fluids from the separate compartments are discharged together and unmixed from said nozzle.

3. The dispenser of claim 1 in which said vent means comprises a venting tube mounted in said seal cap means for each of said spaces vacated by discharging viscous liquid.

4. The dispenser of claim 3 having means to insure that each compartment is emptied completely.

5. The dispenser of claim 1 having means to compensate for shrinkage of hot liquid as said liquid cools without distorting any part of said dispenser.

6. The dispenser of claim 1 having means to permit said rotatable knob to be reversed for a limited number of degrees of rotation after each dispensing to pull excess liquid out of said nozzle.

7. A dispenser for viscous liquids comprising:

(a) a cylindrical main body open at the upper end and having nozzle means closing the lower end of said main body for containing said viscous liquids;

(b) stationary seal cap means fitted into the top opening of and sealing off the upper end of said main body;

(c) knob means for covering the upper end of said main body and said seal cap means;

(d) a pair of oppositely located and aligned stationary flat walls of rectangular configuration mounted axially along the interior surface of said main body, each flat wall having a first edge attached to said interior surface with said flat wall extending radially inwardly with the opposite second edge of each flat wall located parallel to and spaced from the central axis of said main body, the width between the first and second edges of each said flat wall being less than the radius of said main body so that there is an axially extending gap between the second edges of said flat walls;

(e) a rotatable center rod extending through and along the central axis of said main body fitted between and contacting the second edges of said flat walls, said center rod having a pair of flat vanes extending radially out from the outer surface of said center rod, directly opposite from each other, and extending axially along said hollow rod from the top end of said center rod to a location spaced from the bottom end of said center rod leaving a portion of said center rod extending down beyond said flat vanes, a cavity formed within said center rod extending down from above said location to the lower end of said center rod, the outer edges of said flat vanes in contact with the inner surface of said main body, said center rod in its initial position being with said flat vanes adjacent said stationary flat walls thereby forming two separate compartments in which two different viscous fluids may be contained;

(f) said nozzle means having a hub to receive the bottom end of said center rod extending beyond the lower edges of said flat vanes and a nozzle communicating with the interior of said hub to discharge the viscous liquid within said main body;

(g) means providing communication between said cavity and each of said compartments formed in said main body; and (h) means for permitting said knob means to engage and rotate said hollow center rod so that as said cap means is rotated said center rod and flat vanes are rotated to force said viscous liquids from said compartments into said cavity of said center rod and through said nozzle means for discharge.

8. The dispenser of claim 7 in which said communicating means comprises a pair of slots in opposite sides of said center rod communicating with said cavity permitting flow of viscous liquids from said compartments into said cavity.

9. The dispenser of claim 8 having means to divide said cavity into two pockets, each pocket being in communication with one of said compartments through one of said slots, said fluids being discharged unmixed from said nozzle.

10. The dispenser of claim 7 in which said seal cap means has a central opening, the top end of said center rod passing through said opening, and means for said knob means to engage the top end of said center rod.

11. The dispenser of claim 10 in which said seal cap means has means comprising tubes passing through said seal cap means to vent the space between each said vane and a flat wall between compartments as said vane moves away from said flat wall.

12. The dispenser of claim 11 having means comprising slots located on the bottom of said vanes to insure that each compartment is emptied completely.

13. The dispenser of claim 12 in which said seal cap means and said knob means include means to permit said seal cap and knob means to cooperate to prevent reverse rotation of said knob means as said viscous liquids are being dispensed and to clean out any remaining liquid when dispensing is completed.

14. The dispenser of claim 13 in which said vent means in said seal cap means is sealed prior to initial dispensing by said dispenser.

15. The dispenser of claim 7 in which the outer edges of said flat vanes in contact with the inner surface of said main body and the second edges of said flat walls in contact with the outer surface of said center rod are shaped to produce a wiping action as said center rod is rotated.

* * * * *